US006152059A

United States Patent [19]

Del Raso

[11] Patent Number: 6,152,059

[45] Date of Patent: Nov. 28, 2000

[54] EMERGENCY BULK LIQUID CARGO SPILL PREVENTION SYSTEM

[76] Inventor: Americo Del Raso, 21858 River Oakes Dr., Rocky River, Ohio 44116

[21] Appl. No.: 09/329,397

[22] Filed: Jun. 10, 1999

[51] Int. Cl.[7] ..... B63B 25/08

[52] U.S. Cl. ..... 114/74 R; 114/227

[58] Field of Search ..... 114/74 R, 74 T, 114/227–229

[56] References Cited

U.S. PATENT DOCUMENTS

| | | | |
|---|---|---|---|
| 3,707,937 | 1/1973 | Liles | 114/74 R |
| 3,844,239 | 10/1974 | McLauglin | 114/74 |
| 3,906,880 | 9/1975 | Hebert | 114/74 |
| 4,389,959 | 6/1983 | Conway | 114/74 |
| 5,052,319 | 10/1991 | Beyrouty | 114/74 |
| 5,119,749 | 6/1992 | Velleca | 114/74 |
| 5,125,353 | 6/1992 | McGuinness | 114/74 |
| 5,152,242 | 10/1992 | Bradley | 114/222 |
| 5,203,828 | 4/1993 | Strain | 114/74 R |
| 5,225,812 | 7/1993 | Faghri | 114/74 R |
| 5,271,350 | 12/1993 | Newburger | 114/74 |
| 5,347,943 | 9/1994 | Fujiita | 114/74 |
| 5,349,914 | 9/1994 | Lapo | 114/74 |
| 5,353,728 | 10/1994 | Strange | 114/74 |
| 5,722,341 | 3/1998 | Tornqvist | 114/260 |
| 5,732,644 | 3/1998 | Sell | 114/221 |
| 5,732,650 | 3/1998 | Peterson | 114/345 |
| 5,735,227 | 4/1998 | Goulding | 114/227 |
| 5,921,421 | 7/1999 | Fuquan | 114/74 R |

*Primary Examiner*—Ed Swinehart
*Attorney, Agent, or Firm*—John D. Gugliotta

[57] ABSTRACT

Large bulk liquid cargo tankers are a common sight on the world's oceans and waterways. Petroleum needs worldwide have risen sharply and in order to fulfill those needs cheaply and efficiently, shipbuilders have increased the size of tankers carrying the crude oil to the point where the modern supertanker is capable of carrying millions of barrels of oil in a single trip. Such efficiency has not come without a price in that a single tank rupture can be an ecological and financial disaster. In order to minimize and even the eliminate such a disastrous event, an apparatus has been designed to be deployed inside a bulk liquid cargo tank. Should a tank be ruptured, a large expandable bladder pre-positioned within the tank would expand as oil from within the tank would pe pumped into its internal volume. The expandable bladder serves a dual purpose to act as a seal against the portion of the tank that has been ruptured eliminating the flow of oil out of the tank and seawater into the tank. The present invention is such an expandable recovery bladder with a novel bladder arrangement and a novel fiber optic sensing and control system.

13 Claims, 9 Drawing Sheets

EMERGENCY BULK LIQUID CARGO SPILL PREVENTION SYSTEM

RELATED APPLICATIONS

The present invention was first described in Disclosure Document No. 453899 filed on Mar. 29, 1999. There are no previously filed, nor currently any co-pending applications, anywhere in the world.

BACKGROUND OF THE INVENTION

1. Field of the Invention

The present invention relates generally to pollution prevention and, more particularly, to a bulk liquid cargo spill prevention system of the expandable bladder bladder type for a bulk liquid cargo tanker.

2. Description of the Related Art

In the related art, methods and systems for preventing or controlling the spillage of bulk liquid cargoes such as oil into the sea are well known. In fact, there are many tanker ships whereby the loss of liquid bulk cargoes, usually petroleum products, is attempted to be minimized in case of cargo tank rupture through the ship's design. The most recent and well know is the addition of a second hull to a tanker vessel whereby the outer hull protects the inner hull/cargo tank from rupture. There are also tankers designed with the cargo tanks located relative to the waterline in such a fashion that in the event of a tank rupture, the oil leaking out of the tank is minimized by a phenomena known as hydrostatic lock. There are also tankers with various arrangement of cargo tanks, ballast tanks and piping systems for transferring liquid bulk cargo to the ballast tank in the event of cargo tank rupture.

Each of these methods and designs has its limitations. The double hull tanker significantly increases ship construction costs and seriously affects the ship's stability. Other ship designs employing gravity means or pumps to move liquid bulk cargo to an empty ballast tank generally do so at the expense of decreasing ship stability. Another design provides limited impact protection of a cargo tank by surrounding the tank with a single flexible bladder which deflect and yield to the energy of impact. Similarly, yet another design consists of a protective layer placed against the hull segregated from the liquid cargo by a flexible liner. If the hull is punctured, the protective layer will hold the flexible liner in place and hence the liquid cargo will be prevented from leaking from the tank.

There exist in the art other methods and devices that aren't an integral part of the ship's design but can be employed in the event a liquid bulk cargo tank is ruptured. One design contemplates pumping liquid cargo into a collapsible bladder which is placed over the ship's side into the sea and made buoyant. The bladder is normally stowed in a collapsed configuration on deck ready for immediate deployment. Another design contemplates a collapsible bladder normally stowed within a cargo tank that the liquid cargo can be pumped into in the event the tank is ruptured. The bladder is designed to conform to the interior contour of the cargo tank and as the liquid cargo pumped into the bladder causes the bladder to expand the interior volume of the tank is encapsulated. The outer wall of the bladder then forms a seal on the ruptured wall of the tank preventing any further flow of seawater into the tank. There is no further discharge of liquid cargo since all of the liquid cargo in the tank has been pumped into the bladder.

The present invention is of the collapsible bladder type stowed in the cargo tank with a novel collapsible bladder arrangement and control system.

A search of the prior art did not disclose any patents that read directly on the claims of the instant invention; however, the following references were considered related:

| U.S. Pat. No. | Inventor | Issue Date |
|---|---|---|
| 4,389,959 | Conway | June 28, 1983 |
| 5,052,319 | Beyrouty | October 1, 1991 |
| 5,347,943 | Fujita, et al. | Sep. 20, 1994 |
| 5,353,728 | Strange | Oct. 11, 1994 |
| 5,271,350 | Newburger | Dec. 21, 1993 |
| 5,349,914 | Lapo, et al. | Sep. 27, 1994 |
| 5,735,227 | Goulding | April 7, 1998 |
| 3,844,239 | McLaughlin et al. | Oct. 29, 1974 |
| 3,906,880 | Hebert | Sep. 23, 1975 |
| 5,119,749 | Velleca, et al. | June 9, 1972 |
| 5,125,353 | McGuiness | June 30, 1992 |

The above list of patents can be divided into two groups. The first group of patents are considered related to but not directly relevant to the present invention and require no further discussion:

U.S. Pat. No. 4,389,959 issued to Conway discloses an improved tanker vessel of the type where the liquid cargo tanks are arranged in such a fashion that should the hull be breached the liquid cargo is prevented from leaking from the hull through hydrostatic loading;

U.S. Pat. No. 5,052,319 issued to Beyrouty discloses a collapsible bladder which can stored on deck but deployed over the side to pump liquid cargo from a ruptured leaking cargo tank;

U.S. Pat. No. issued to Fujita et al., discloses another tanker design where the hull is of a double layer design where the outer layer is supposed to protect the inner layer, serving also as the outerwall of a liquid cargo tank, from further damage. In addition, the liquid cargo tanks are arranged in such a fashion that should the hull be breached the liquid cargo is prevented from leaking from the hull through hydrostatic loading;

U.S. Pat. No. 5,353,728 issued to Strange discloses an improved tanker design where a passive, gravity-responsive, fluid transfer system provides very rapid fluid communication between selected cargo tanks and adjoining ballast tanks;

U.S. Pat. No. 5,271,350 issued to Newburger discloses an apparatus comprised of a series of bladder modules whose walls are made of a flexible material of sufficient strength to substantially withstand rupture upon such impact. Each flexible module comprises an inboard cargo-carrying bladder surrounded out-boardedly by a buffer bladder containing air under pressure;

U.S. Pat. No. 5,349,914 issued Lapo, et al., discloses a device for impeding the spillage of a liquid cargo which consists of a protective layer placed against the inner surface of the hull and a flexible inner layer placed between the protective layer and the liquid cargo, so that if the hull is punctured, the protective layer will hold the flexible liner and the liquid cargo in place;

U.S. Pat. No. 5,735,227 issued to Goulding discloses an apparatus for sealing a rupture in a wall comprised of a backing plate and a seal. The '227 reference teaches that such an apparatus may be used to seal a ruptured hull of a ship.

The second group of patents from the list above are considered relevant and directly related to the present invention:

U.S. Pat. No. 3,844,239 issued to McLaughlin et al. discloses a liquid carrying tanker with an impermeable, elastomeric tailored lining releasably fixed to the inner walls of the liquid cargo tank, the lining being adapted to separate from the walls of the tank when the tanks are impacted such as when the ship is in a collision or grounded. The distortion of the liner causes the liquid pressure in the liner to increase and force the liquid from the liner into another tank;

U.S. Pat. No. 3,906,880 issued to Hebert discloses a vinyl liner manufactured to fit within and conform to the interior of a liquid cargo carrying tank. Said liner is fixed to the top of the tank and designed to be dropped into the tank and have the liquid cargo from the tank pumped into when the tank is ruptured;

U.S. Pat. No. 5,119,749 issued to Velleca, et al. discloses another system whereby liquid from a ruptured cargo tank is to be pumped into a flexible liner located within the tank for rapid deployment. The expanded liner holding the liquid cargo prevents it from leaking through the hull and at the same time seals the ruptured hull preventing seawater from further entering the hull;

U.S. Pat. No. 5,125,353 issued to McGuiness discloses yet another system whereby liquid from a ruptured cargo tank is to be pumped into a flexible liner. The expanded liner holding the liquid cargo prevents it from leaking through the hull and at the same time seals the ruptured hull preventing seawater from further entering the hull. However, the '353 reference indicates that this system is not fixedly connected to the interior of a cargo tank but is to be dropped through a hatch in the top of the tank when needed.

With the exception of the '353 reference, all of the inventions in the second group are like the present invention in that they all have a flexible, collapsible liner or bladder which is fixedly connected to the interior of a cargo tank for rapid deployment should one of the tank walls be breached. Once the tank wall is breached, a pumping means pumps the liquid cargo into the bladder causing it to expand. The liner or bladder was manufactured to conform to the interior of the tank so that any obstacles in the tank would not impede the expansion of the tank and so that the entire volume of liquid can be pumped into the bladder. The expanded bladder also serves to form a seal against the inner wall of the tank which was ruptured preventing any further spillage of seawater into the tank.

What is different about the present invention from the these inventions is a novel means whereby the collapsible bladder is fixedly connected to an interior sidewall of the tank and deployed suspended hanging from a track via a tram and trolley assembly. Suspending the bladder from the track in this manner not only guarantees the successful deployment of said bladder but also allows the bladder to be retracted and collapsed back correctly when the tank rupture has been fixed. A novel means for sensing when a tank is ruptured and signaling when to deploy the bladder is also disclosed using an advanced fiber optics sensing system. In addition, a pumping means integrated into the design of the ship and the cargo tanks is disclosed with a self-actuating emergency backup system being further provided. None of the aforementioned prior art discloses any type of control system for use with such a emergency bladder system or a means for sensing when to employ said system as in the present invention.

Consequently, a need has been felt for providing an apparatus for containing liquid cargo when a cargo tank is ruptured which can be deployed rapidly, automatically, is retractable and reuseable, and provides an emergency backup means should power from the tanker be unavailable. The present invention fulfills this need.

SUMMARY OF THE INVENTION

It is therefore an object of the present invention to provide an improved emergency expandable bladder for containing and encapsulating the liquid cargo from a ruptured liquid cargo tank.

It is a feature of the present invention to provide a novel control means whereby a ruptured tank is detected automatically and said emergency expandable bladder is deployed It is another feature of the present invention to provide a novel configuration of the emergency expandable bladder whereby said bladder is fixedly connected to an interior sidewall of a liquid cargo tank and deployed slidably suspended from an overhead track.

It is yet another feature of the present invention that the emergency expandable bladder be retractable after successful deployment of said bladder and repair of the breached liquid cargo tank.

It is still yet another feature of the present invention to provide a pumping means to pump the liquid cargo from a breached cargo tank into said emergency expandable bladder.

A further feature of the present invention to provide an emergency backup means to provide power for the control system and to the pumping means should ship's electrical power suddenly become unavailable.

Yet another feature of the present invention is that the placement of the liquid cargo tanks and accompanying segregated ballast tanks are such that should the cargo tanks be breached, the liquid cargo is in hydrostatic equilibrium with the seawater on the exterior of the ship's hull.

Still yet another feature of the present invention is that a segregated ballast tank is provided for receiving liquid cargo from another portion of the cargo tank located beneath a portion of the cargo tank designed to be encapsulated by said bladder. Said segregated ballast tank is provided with a venting means for venting an inert gas previously injected into said tank when receiving liquid cargo from tank as described above.

Yet still another feature of the present invention is a system for providing and supplying an inert gas such as nitrogen to the segregated ballast tanks to reduce the oxygen content in said tank to below explosive levels.

Briefly described according to the preferred embodiment of the present invention, an emergency expandable bladder is provided comprised of a collapsible, accordion-like bladder made from a sturdy, impermeable material manufactured to conform to the individual contour of the interior of a liquid cargo tank. The bladder is attached to the interior side of the inboard sidewall of the liquid cargo tank and expands in an outboard direction as liquid from within the ruptured tank is pumped from the tank into the bladder. To ensure successful expansion of the bladder, the bladder is slidably suspended overhead from a plurality of tracks traversing the top of the tank. Suspending the bladder in this manner also ensures that the bladder can be retracted and returned to the same configuration once the tank rupture is repaired. The liquid cargo tank consists of four sidewalls, one of which is usually the ship's outer hull, a top wall, a bottom wall which is usually the ship's bottom hull, and an oil deck used to define the tank into an upper volume and a lower volume. Said expandable bladder is designed only to encapsulate said upper volume. A plurality of elongated holes in said oil deck allows free communication of liquid cargo from said upper volume to said lower volume.

Located adjacent to said liquid cargo tank and on the inboard side of said tank is a segregated ballast tank for receiving liquid cargo from said lower volume of said liquid cargo tank in the event said liquid cargo tank is ruptured. Prior to filling said liquid cargo tank, an inert gas such as nitrogen or exhaust gas from the ship's flue is used to pressurize said ballast tank and to reduce the oxygen content in said ballast tank to a level where ignition or explosion of the vapors in said ballast tank is not possible. A relief valve connected to and controlled by said emergency expandable bladder control system vents said inert gas to the atmosphere in the event the adjacent liquid cargo tank is ruptured and the expandable bladder deploys. The segregated ballast tank further has a valve located in the bottom of said tank to allow, when in an open position, free communication of liquid cargo through a channel connected to the lower volume of said liquid cargo tank with the interior of said ballast tank. Said valve is kept in the closed position upon filling said ballast tank with inert gas and liquid cargo tank with liquid cargo. Once both tanks are filled, said valve is opened. Inert gas pressure equal to the liquid cargo pressure at the valve pressure head keeps liquid cargo from said liquid cargo tank from coming into the ballast tank until such time as when inert gas is vented to the atmosphere. This pressure would have to be calculated beforehand and would depend on the volume of both tanks and the specific gravity of both the inert gas and the liquid cargo. The channel is formed by the bottom wall of said ballast tank and the bottom hull of the ship. Said free fluid communication is desirable when the liquid cargo tank has been ruptured and after said inert gas has been vented to the atmosphere from said ballast tank. Located within said channels are a series of flapper check valves to allow the flow of liquid cargo in only one direction from the lower volume of the liquid cargo tank to the segregated ballast tank. The flapper valves are placed over an aperture formed through and located on the inboard side of a longitudinal I-Beam section perpendicularly traversing the channel and forming an integral part of the ships supporting structure.

Located on the outer sidewall but on the inner surface of the liquid cargo tank are a plurality of sense cables encased in a tube tack-welded and placed perpendicularly at evenly spaced intervals along a plurality of steel longitudinal sections forming the supporting framework of the outer sidewall of said liquid cargo tank. Another plurality of sense cables enclosed in a conduit are tack-welded on the interior side of the bottom of the liquid cargo tank. One end of the sense cables are attached to the hull structure of the ship while the other end is connected to a switch. The switch is connected to a fiber optic cable for sending a signal to the control system indicating that one of the sense cables has been disturbed by a distortion of the hull the sense cable was located adjacent to.

The control system receiving the signal actuates a relay, which in turn actuates an electric motor, or alternately a diesel engine, both of which are mechanically coupled to drive a hydraulic pump to supply hydraulic pressure to a hydraulic motor located in a sump situated between the liquid cargo tank and the segregated balance tank. The bottom plate of the sump is actually the upper surface of the oil deck with the elongated holes allowing free fluid communication of cargo liquids from the lower volume of the liquid cargo tank through the channel formed by the oil deck and the bottom hull.

Located within the sump is a hydraulic motor having an inlet to receive cargo liquids, an impeller driven by the hydraulic motor to pump cargo liquids through piping which delivers it to the interior of the expandable bladder. Fluid pressure now building up within the bladder forces the bladder to expand and move in an outboard direction suspended overhead by a plurality of rollers and tracks. Once the entire volume of fluid has been pumped from within the liquid cargo tank into the bladder, the bladder should now be fully expanded and the exterior of the bladder surface should now cover over the ruptured hull preventing any further seawater from entering the hull. The liquid cargo may remain in the bladder until such time as the rupture may be repaired in a shipyard. Once the rupture is repaired, the bladder may be retracted into its original stowed configuration by pumping the fluid back out of the bladder by reversing the direction of the hydraulic motor/impeller.

A backup battery is provided to supply power to the control system when ship's power is not available. Upon receiving a signal that a liquid cargo tank has been breached and that no ship's power is available, a relay energizes an electric starter motor to start a backup diesel engine. The backup diesel engine delivers the rotary power formerly delivered by the electric motor to drive the hydraulic pump supplying the hydraulic pressure to the hydraulic motor/impeller to pump fluid from the liquid cargo tank into the emergency expandable bladder.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

Figure 1:
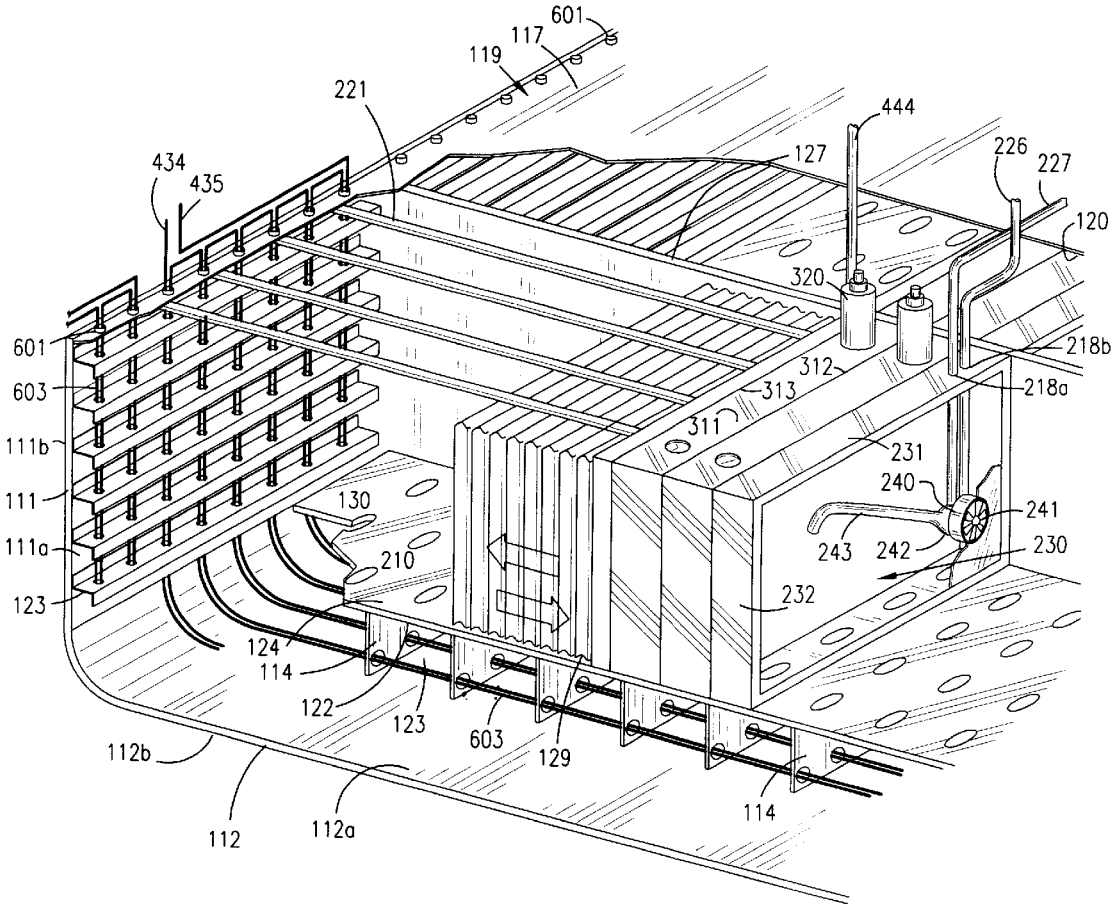
FIG. 1 is a cutaway elevated perspective view of the stern of a bulk liquid cargo tanker showing a typical placement of the emergency expandable bladder system in the aft-most port side liquid cargo tank.

| LIST OF REFERENCE NUMBERS | |
|---|---|
| 100 | Tanker |
| 110 | Hull |
| 111 | Hull Sidewall |
| 111a | Inner Surface Hull Sidewall |
| 111b | Outer Surface Hull Sidewall |
| 112 | Hull Bottom |
| 112a | Inner Surface Hull Bottom |
| 112b | Outer Surface Hull Bottom |
| 113 | Keel |
| 114 | Bottom Hull Longitudinal I-Beam |
| 115 | Aperture |
| 116 | Hull Sidewall Longitudinal Channel |
| 117 | Main Deck Plate |
| 118 | Aperture |
| 119 | Outer Surface Main Deck Plate |
| 120 | Inner Surface Main Deck Plate |
| 121 | Main Deck Longitudinal I-Beam |
| 122 | Oil Deck Plate |
| 123 | Lower Surface Oil Deck |
| 124 | Upper Surface Oil Deck |
| 125 | Elongated Apertures |
| 126 | Liquid Cargo Tank |
| 127 | Liquid Cargo Tank Forward Sidewall |
| 128 | Liquid Cargo Tank Aft Sidewall |
| 129 | Liquid Cargo Tank inboard Sidewall |
| 130 | Liquid Cargo Tank Upper Volume |

-continued

| LIST OF REFERENCE NUMBERS | |
|---|---|
| 131 | Liquid Cargo Tank Lower Volume |
| 200 | Emergency Expandable Bladder Assembly |
| 210 | Expandable Bladder |
| 211 | Exterior Sidewalls |
| 212 | Interior Sidewalls |
| 213 | Piping Inlet |
| 214 | Tracks |
| 215 | Hangars |
| 216 | Rollers |
| 217 | Sump |
| 218 | Top plate |
| 219 | Aft Wall |
| 220 | Forward SideWall |
| 221 | Hydraulic Motor |
| 222 | Impeller |
| 223 | Impeller Housing |
| 224 | Impeller Housing Inlet Piping and Float |
| 225 | Discharge Aperture |
| 226 | Inlet Piping |
| 227 | Outlet Piping |
| 300 | Segregated Ballast Tank |
| 311 | Tank Top Plate |
| 312 | Inboard Sidewall |
| 313 | Outboard Sidewall |
| 314 | Forward Sidewall |
| 315 | Aft Sidewall |
| 320 | IGS Relief Valve |
| 321 | IGS Inlet Piping |
| 322 | IGS Gas Outlet Piping |
| 330 | Segregated Ballast Tank Valve Assembly |
| 331 | Hand Wheel/Actuator |
| 332 | Transmission Shaft |
| 333 | Valve Cover |
| 334 | Ring |
| 335 | Aperture |
| 340 | Channel |
| 341 | Flapper Check Valve |
| 342 | Aperture |
| 400 | Expandable Bladder Power & Control System |
| 401 | Inverter |
| 402 | Wiring Harness |
| 403 | Battery Pack |
| 404 | Wiring Harness |
| 405 | Wiring Harness |
| 406 | Wiring Harness |
| 407 | Ship's Service Three Phase Power Supply |
| 408 | Two Wire Step Down Transformer |
| 409 | Wiring Harness |
| 410 | Diesel Engine Starter Motor Relay |
| 411 | Wiring Harness |
| 412 | Diesel Engine Starter Motor |
| 413 | Diesel Engine |
| 414 | Diesel Engine Clutch |
| 415 | Wiring Harness |
| 416 | Fuel Valve Switch |
| 417 | Oil Pressure Switch |
| 418 | Wiring Harness |
| 419 | Relay |
| 420 | Electric Motor Contactor |
| 421 | Shaft/Armature of Electric Motor |
| 422 | Electric Motor |
| 423 | Shaft to Hydraulic Pump |
| 424 | Wiring Harness |
| 425 | Main Power Bus |
| 426 | Wiring Harness |
| 427 | Wiring Harness |
| 428 | Wiring Harness |
| 429 | Transformer |
| 430 | Wiring Harness |

-continued

| LIST OF REFERENCE NUMBERS | |
|---|---|
| 431 | Switches On/Off |
| 432 | Wiring Harness |
| 433 | Light Beam Emitter |
| 434 | Optic Fiber Cable |
| 435 | Optic Fiber Cable |
| 436 | Beam Splitter |
| 437 | Optic Fiber Cable |
| 438 | Annunciator Panel |
| 439 | Annunciator Light |
| 440 | Optic Fiber Cable |
| 441 | Optic Fiber Cable to Electric Eye |
| 442 | Electric Eye |
| 442 | Relay |
| 443 | Wiring Harness |
| 444 | Wiring Harness |
| 445 | Wiring Harness |
| 446 | Wiring Harness |
| 447 | Wiring Harness |
| 448 | Relay DPST |
| 449 | Wiring Harness |
| 450 | Wiring Harness |
| 451 | Horn |
| 500 | Hydraulic Subsystem |
| 501 | Valve |
| 502 | Hydraulic Reservoir |
| 503 | Hydraulic Pump |
| 504 | Filter |
| 505 | Hydraulic Pressure Supply Piping |
| 506 | Pressure Gauge |
| 507 | Pressure Regulator |
| 508 | Check Valve |
| 509 | Supply Manifold |
| 510 | Piping |
| 511 | Piping |
| 512 | Pressure Relief Valve |
| 513 | Return Manifold |
| 514 | Filter |
| 515 | Hydraulic Supply Piping |
| 515a | Piping |
| 515b | Valve |
| 515c | Piping |
| 515d | Valve |
| 515e | Piping |
| 516 | Hydraulic Return Piping |
| 516a | Piping |
| 516b | Valve |
| 516c | Piping |
| 516d | Valve |
| 516e | Piping |
| 517 | Check Valve |
| 518 | Piping |
| 600 | Fiber Optic Switch and Sense Cable Assembly |
| 601 | Fiber Optic Switch |
| 601a | Plunger |
| 601b | Cutter |
| 601c | Jumper |
| 601d | Cradle |
| 601e | Switch Body |
| 601f | Switch Cover |
| 601g | Eyelet |
| 601h | Spring |
| 601i | Aperture |
| 601j | Aperture |
| 601k | Eyelet |
| 602 | Sense Cable |
| 603 | Sense Cable Conduit |
| 604 | Teflon Sleeve |
| 605 | Support Bracket |
| 606 | Aperture |
| 607 | Eyelet |
| 608 | Support Bracket |

DESCRIPTION OF THE PREFERRED EMBODIMENTS

The best mode for carrying out the invention is presented in terms of its preferred embodiment, herein depicted within the Figures. 1. Detailed Description of the Figures Referring now to FIG. 1, shown is an Emergency Expandable Bladder Assembly 200 for the containment of liquid cargo comprised of a liquid tight Expandable Bladder 210 having an interior volume for receiving liquid cargo from a ruptured liquid cargo tank. Said Expandable Bladder 210 is fixedly attached to an Inboard Sidewall 129 of an otherwise conventional Liquid Cargo Tank 126 . A bulk liquid cargo Tanker 100 would typically have a plurality of such Liquid Cargo Tanks 126 located from fore to aft in the cargo hold and port and starboard of the Tanker 100 Keel 113 comingled with conventional ballast tanks in such a configuration as to optimize Tanker 100 stability and buoyancy.

The Bulk Liquid Cargo Tank 126 of FIG. 1 is one from a plurality of such tanks and is typical of such tanks throughout Tanker 100. The Bulk Liquid Cargo Tank 126 shown is the aft-most port side located tank of such tanks. In an alternate embodiment, such tanks may even be stacked one above the other. The placement and arrangement of said Bulk Liquid Cargo Tanks 126 in any embodiment is dependent on a principle known as hydrostatic loading or lock along with stability and buoyancy considerations. Under this principle it is desirable to have the level of fluid in Bulk Liquid Cargo Tank 126 in relation to the waterline along Hull 110 such that if rupture of Bulk Liquid Cargo Tank 126 were to occur the hydrostatic pressure on both sides of the rupture would be nearly equal minimizing leakage of cargo fluid through Hull 110. Only one Liquid Cargo Tank 126 is shown to show the essence of the present invention.

A Bulk Liquid Cargo Tank 126 is comprised of a Forward Sidewall 127, an Aft Sidewall 128, an Inboard Sidewall 129, a Top Plate 117, an Outboard Sidewall 111 also serving as the Tanker 100 Outer Hull 110, a Bottom Wall 112 also serving as the Hull Bottom 112, and an Oil Deck Plate 122 segregating the Liquid Cargo Tank 126 into an Upper Volume 130 and a Lower Volume 131. A plurality of Elongated Apertures 125 allow free communication of liquid cargo in Tank 126 from Lower Volume 131 and Upper Volume 130.

The Expandable Bladder 210 is slidably suspended from a plurality of elongated Tracks 221 slotted along the elongated longitudinal axis of said Tracks 221 to receive a plurality of Rollers 216 made to fit and roll longitudinally within said slot. The Expandable Bladder 210 is connected to Rollers 216 via a plurality of hangars 215. The Expandable Bladder 210 is manufactured to fold accordion-like and stow against the Inboard Sidewall 129 of Tank 126 and to fit exactly inside the Upper Volume 130 of Tank 126 when fully expanded.

In the event of Tank 126 rupture, liquid cargo from Lower Volume 131 would initially be forced into Segregated Ballast Tank 300 by a drop in pressure in said Segregated Ballast Tank 300 created when inert gas pumped into Tank 300 is vented to the atmosphere. Liquid cargo from Upper Volume 130 would naturally flow to Lower Volume 131 via Elongated Apertures 125 in Oil Deck 122. Located directly adjacent to Liquid Cargo Tank 126, and between Segregated Ballast Tank 300, sits a Sump 217 containing a Hydraulic Motor 221. Sump 217 is formed by a Top Plate 218, a Forward Sidewall 220, an Aft Sidewall 219, and the Inboard Sidewall 129 of Liquid Cargo Tank 126 and the Outboard Sidewall 313 of Segregated Ballast Tank 300. Sump 217 is also in fluid communication with Lower Volume 131 via Apertures 125 because its bottom wall is also formed from Oil Deck 122. Liquid cargo flowing up into Sump 217 is drawn into Impeller Housing Inlet Piping and Float 224 when Hydraulic Motor 221 is activated. Fluid drawn into Impeller Housing 223 is discharged into Expandable Bladder 210 through Discharge Aperture 225. The pressure from the liquid cargo being pumped into the Expandable Bladder 210 causes expansion of the Expandable Bladder 210 slidably outboard into Tank 126. Once the cycle is complete all liquid cargo formerly in Upper Volume 131 or Lower Volume 130 will be in either Segregated Ballast tank 300 or Expandable Bladder 210. The exterior surface of Expandable Bladder 210 is now directly adjacent to and butting the outboard sidewall, or actually the Inner Surface Hull Sidewall 111*a* of the Upper Volume 130 of Tank 126. A rupture in that Sidewall 111*a* would now be covered over by the exterior of Expandable Bladder 210 sealing that rupture until such time as when Expandable Bladder 210 is emptied. In the event of a bottom rupture, the system operates identically as just described, however, liquid cargo that was formerly in Lower Volume 131 and an adjacent channel 340 is now replaced by seawater which would remain there until the rupture is repaired.

The entire sequence is activated by a Fiber Optic Control and Sense Cable Assembly 600 system connected to Sense Cables 602 located along the walls of the vulnerable portions of the Liquid Cargo Tank sidewalls/outer hull 110 sections. A distortion in these sections such as when there is a collision or grounding will cause the sense cable to rupture a light signal flowing through a Fiber Optic Switch 601 causing the Emergency Expandable Bladder Assembly 200 to become operational.

Figure 2:
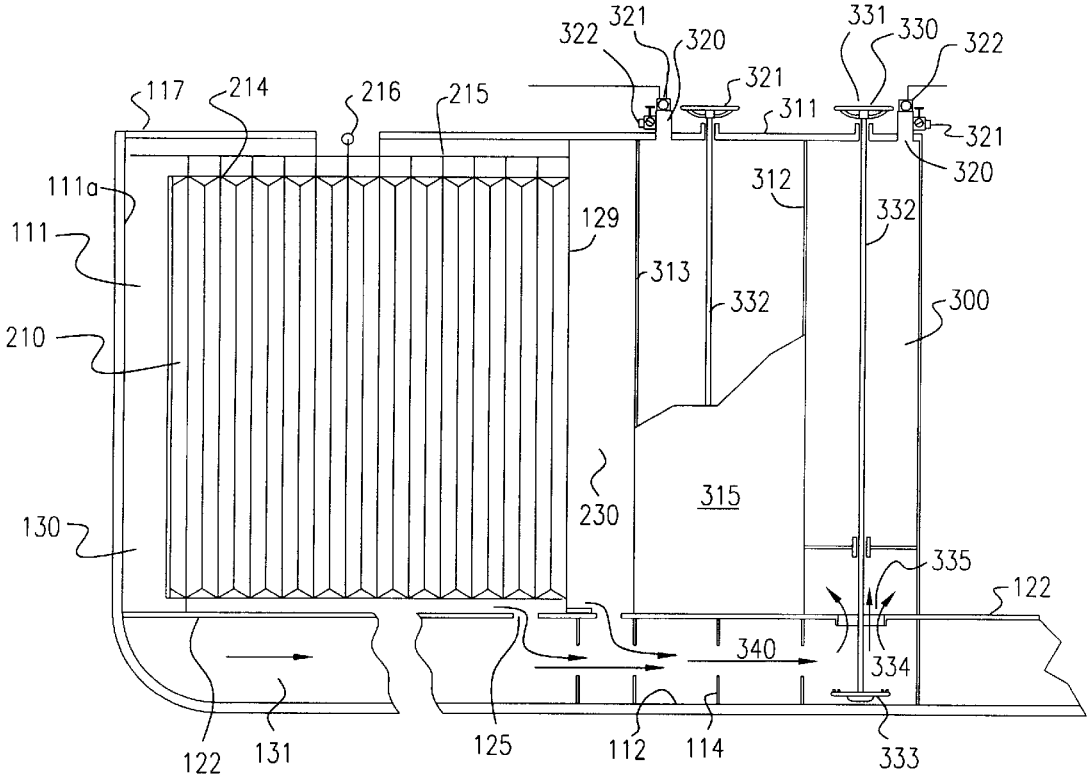
FIG. 2 is a cutaway rear view of the port side of the bulk liquid cargo tanker shown in FIG. 1 showing a typical emergency expandable bladder assembly installed in a liquid cargo tank and the segregated ballast tank located adjacent to it.

Referring now to FIG. 2, shown is an Emergency Expandable Bladder Assembly 200 for the containment of liquid cargo comprised of an Expandable Bladder 210 fixedly attached to the Inboard Sidewall 129 of Liquid Cargo Tank 126. More detail of the manner in which Expandable Bladder 210 is slidably attached via a plurality of Hangars 215 and Rollers 216 to Tracks 221 is shown. Also shown in more detail is the segregation of Cargo Tank 126 into an Upper Volume 130 and a Lower Volume 131 by Oil Deck 122. Free fluid communication of liquid cargo from Upper Volume 130 and Lower Volume 131 is accomplished through Apertures 125 in Oil Deck 122. Free fluid communication of liquid is also accomplished to the adjacent Segregated Ballast Tank 300 through a Channel 340 formed by a plurality of Apertures 342 formed in a plurality of Longitudinal I-Beams 114 forming the support structure for the Hull Bottom 112 and bottom sidewall of Liquid Cargo Tank 126.

The detail of Segregated Ballast Tank 300 is shown provided with a Valve Assembly 330 comprised of a Hand Wheel/Actuator 331, Transmission Shaft 332, Valve Cover 333, Aperture 335, and Ring 334. The Valve Assembly 330 is normally kept in an open position but is closed when the Segregated Ballast Tank 300 is filled with an inert gas such as nitrogen and Liquid Cargo Tank 126 is filled with liquid cargo. Once Liquid Cargo Tank 126 is filled, Valve Assembly 330 is opened allowing free fluid communication of fluid from Lower Volume 131 of Liquid Cargo Tank 126 through Channel 340 to Segregated Ballast Tank 300.

In the event of a Liquid Cargo Tank 126 rupture, IGS Relief Valve 320 is signaled to open via current from Electric Eye 442 via Wiring Harness 444 and IGS gas is vented to the atmosphere. IGS Relief Valve 320 remains in the open position until IGS gas in Segregated Ballast Tank 300 is at a designated pressure. The immediate evacuation of IGS gas results in a dramatic drop in pressure in Segregated Ballast Tank 300 drawing liquid cargo from the Lower Volume 131 of Liquid Cargo Tank 126 into Segregated Ballast Tank 300 where it remains until such time that the oil/water mixture is pumped out. The remainder of the liquid cargo is pumped into Expandable Bladder 210 as described heretofore. In an alternate embodiment (not shown), it is envisioned that a system of interconnecting piping and pumps will pump liquid cargo from Segregated Ballast Tank 300 into Expandable Bladder 210 after being separated from seawater that mixed with the liquid cargo upon rupture. Separation of seawater from liquid cargo normally requires a water/oil separator. This whole process requires that Valve Assembly 300 also be closed once Ballast tank 300 is filled with a mixture of liquid cargo and seawater. The separated seawater is then pumped overboard. This system has a two fold purpose. The first is to recover liquid cargo from said Segregated Ballast Tank 300. The other is to transfer liquid cargo back into the ruptured cargo tank 126 to regain lost stability and buoyancy caused by the shifting liquid cargo.

Figure 3:
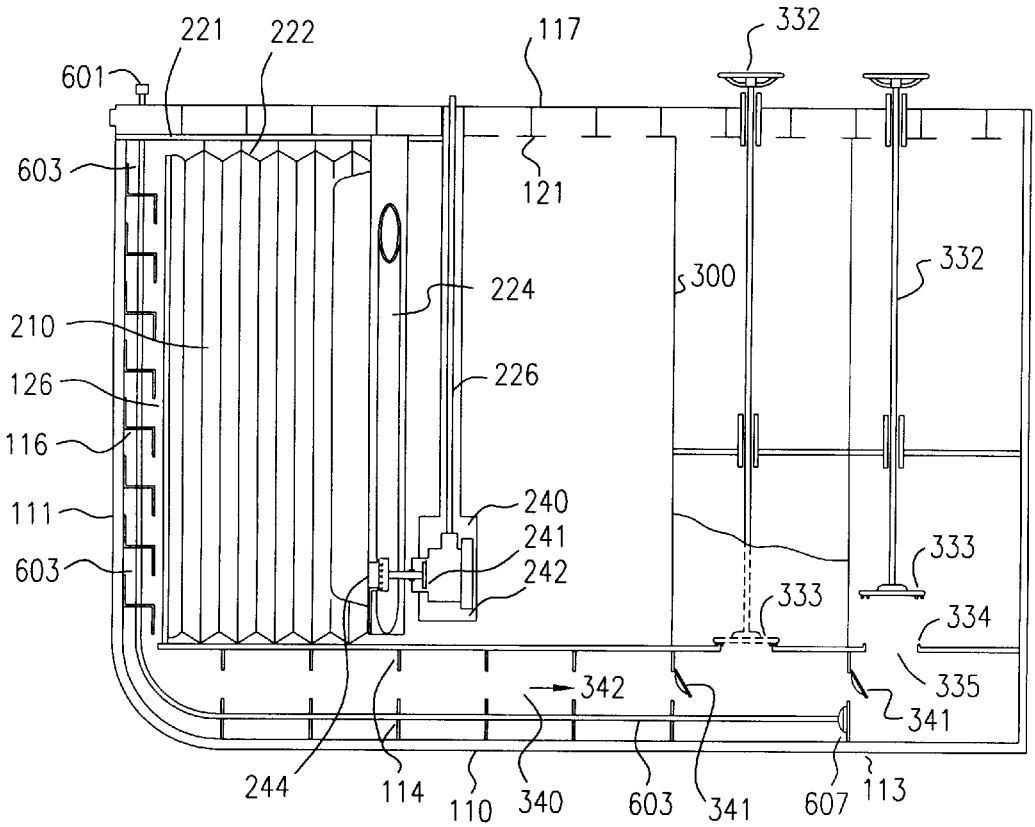
FIG. 3 is a cutaway rear view of the port side of the bulk liquid cargo tanker show in FIG. 1 showing the installation of the emergency expandable bladder installed slidably hanging from an overhead track in a liquid cargo tank and the placement of the hydraulic motor, impeller, and piping inlet in the adjacent sump.

Referring now to FIG. 3, shown is more detail of Channel 340 connecting the Lower Volume 131 of Liquid Cargo Tank 126 made from a plurality of Apertures 342 in a plurality of Longitudinal I-Beams 114 forming the support structure of Hull Bottom 112 and the bottom sidewall of Liquid Cargo Tank 126 bottom hull allowing free fluid communication between Lower Volume 131 and Segregated Ballast Tank 300. A plurality of Flapper Check Valves 341 placed over said Apertures 342 prevents backflow of both liquid cargo and IGS gas to Lower Volume 131. Also shown is the Hydraulic Motor 221/Impeller 222 within Sump 217. Discharge Aperture 225 formed on the outboard side of Impeller Housing 223 allows free fluid communication of Impeller 222 with the interior of Expandable Bladder 210. A plurality of Fiber Optic Switch and Sense Cable Assemblies 600 are also provided at evenly spaced intervals along the vulnerable sections of outboard sidewall/Hull Sidewall 111 of Liquid Cargo Tank 126 and bottom sidewall/Hull Bottom 112.

Figure 4A:
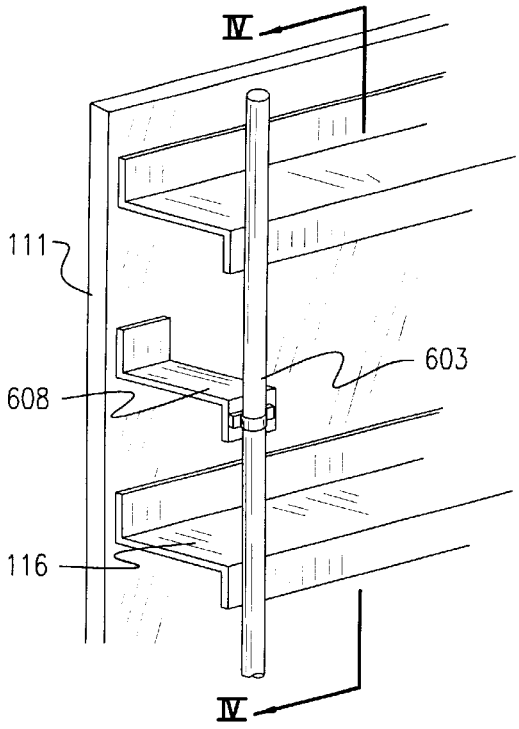
FIG. 4*a* is a rear cutaway view of the port side of the liquid bulk cargo tanker shown in FIG. 1 showing the placement of a plurality of fiber optic switch assemblies through an aperture formed in the outer deck plate and the placement of a plurality of sense cable assemblies tack-welded perpendicularly to the longitudinal channels which form the supporting framework of the outer sidewall of a port liquid cargo tank and the port side of the hull of the tanker.
Figure 4B:
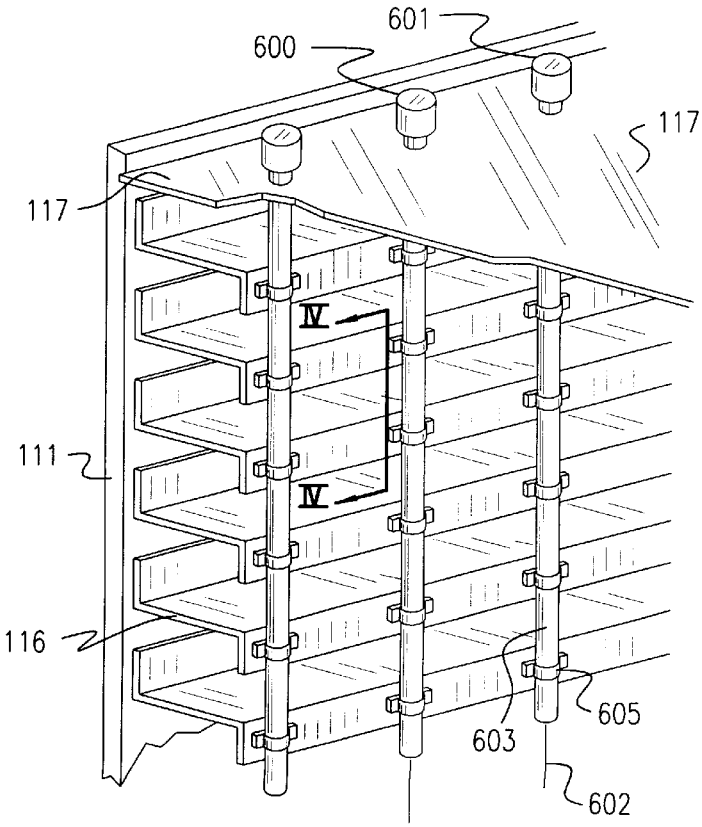
FIG. 4*b* is a perspective cut away view of the port hull sidewall taken along line IV—IV of FIG. 4*a* showing the detail of the connection of a sense cable conduit to the hull sidewall elongated longitudinal channels and the attachment of an optional support bracket.

Referring now to FIG. 4, a cutaway rear perspective view of a portion of the port side hull structure of a Bulk Liquid cargo Tanker 100 is shown showing the Main Deck Plate 117 connected to a portion of the Hull 110. A bulk liquid cargo tank rupture sensing means lining the outboard sidewall and the bottom wall of a typical Bulk Liquid Cargo Tank 126 is shown. Said means consists of a plurality of evenly spaced Fibre Optic Switches 601 fitted in an Aperture 118 penetrating the Main Deck Plate 117 adjacent to the outboard edge of Main Deck Plate 117. Each of said Fiber Optic Switch 601 is ganged to each other in series through fiber optic cabling and designed to interrupt a beam of light flowing through said Fiber Optic Switches 601 upon indicia to any one of said Fiber Optic Switches 601 that a bulk liquid cargo tank has been ruptured. Connected to each of said Fibre Optic Switches 601 on the Inner Surface 120 side of Main Deck Plate 117 is a Conduit 603 containing coaxially therein a hollow Teflon Sleeve 604 which has located coaxially and slidably therein one of said Sense Cables 602. Said Sense Cables 602 line at evenly spaced intervals the inner surfaces of said tank side walls that also serve as a portion of the ship's hull and designed to transmit an indicia of a distortion in said tank walls. Conduit 603 is attached via a tack weld to each of the Elongated Longitudinal Channels 116 perpendicular to the elongated longitudinal axis of said Channels 116. A Support Bracket 608 extending from the Inner Surface 111*a* of the Hull Sidewall 111 to Conduit 603 may be added for strength between adjoining Longitudinal Channel Sections 116.

Figure 5A:
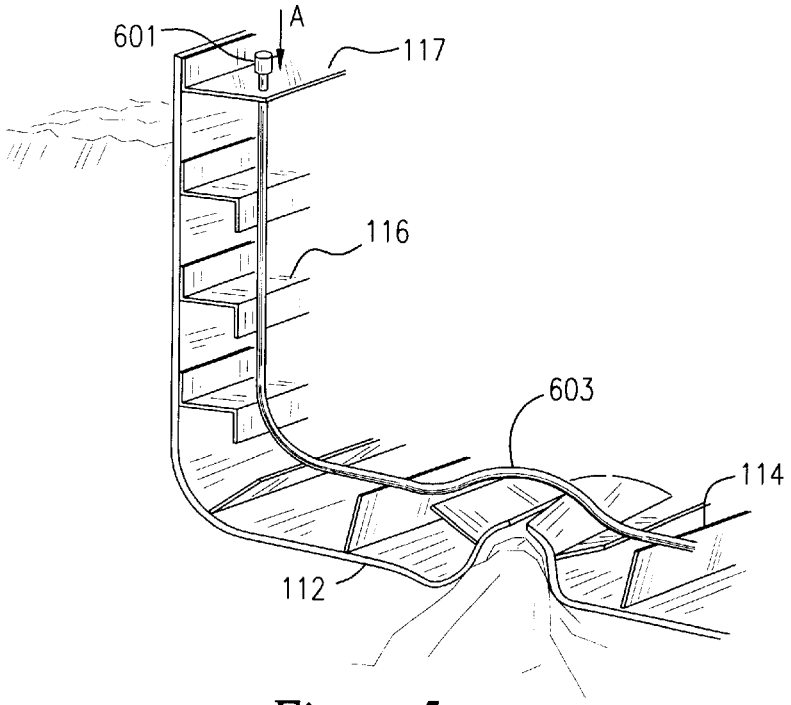
FIG. 5*a* is a cutaway rear view of the port side of the bulk liquid cargo tanker shown in FIG. 1 showing the detail of the placement of one of the fiber optic switches and the sense cable assemblies and its operation when distorted by an impact to the bottom of the liquid cargo tank/bottom hull from an obstacle such as a reef.

Referring now to FIG. 5*a*, shown is a cutaway rear view of a cross section of the lowermost portion of the port Hull Sidewall 111 showing a single placement of the Fibre Optic Switch and Sense Cable Assembly 600. A distortion of the Sense Cable 602 along the Hull Bottom 112 and bottom sidewall of Liquid Cargo Tank 126 is demonstrated by an impact to the Hull Bottom 112.

Figure 5B:
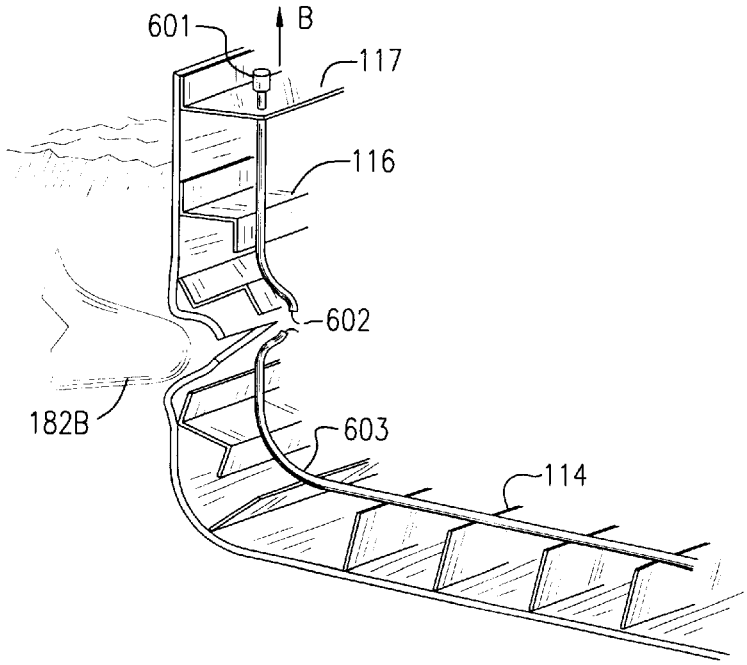
FIG. 5*b* is cutaway rear view of the port side of the bulk liquid cargo tanker shown in FIG. 1 showing the detail of the placement of one of the fiber optic switches and the sense cable assemblies and its operation when distorted by an impact to the outboard side of the liquid cargo tank/side hull as in a collision with another ship.

Referring now to FIG. 5*b*, shown is a cutaway rear view of a cross section of the lowermost portion of the port Hull Sidewall 111 showing a single placement of the Fibre Optic Switch and Sense Cable Assembly 600. A distortion of Sense Cable 602 along the port side of the Hull Sidewall 111 and outboard sidewall of Liquid Cargo Tank 126 is demonstrated by an impact to Hull Sidewall 111.

Figure 6:
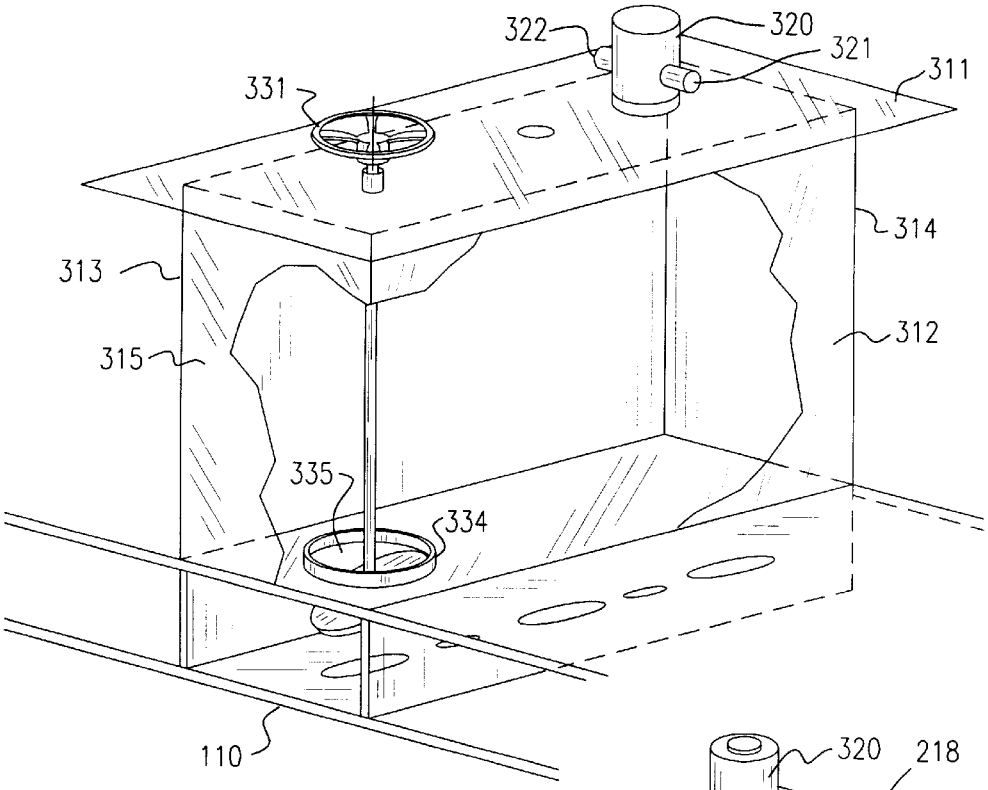
FIG. 6 shows a cutaway elevated perspective view of a typical segregated ballast tank of the liquid bulk cargo tanker of FIG. 1 showing the placement of the Inert Gas System valve/vent on its upper plate and a valve with a manually operated handwheel used for pressurizing the tank shown in the open position.

Referring now to FIG. 6, shown is a perspective view of a typical Segregated Ballast Tank 300 with Valve 330 in the open position. A Hand Actuator 331 is used by the crew to force Valve Cover 333 against Ring 334 via Transmission Shaft 332 to seal Tank 300 when pressurizing with IGS gas through IGS Inlet Piping 321. After Segregated Ballast Tank 300 is pressurized with IGS gas and adjacent Liquid Cargo Tank 126 is filed with cargo liquid, Valve 330 is manually opened allowing free fluid communication of IGS gas with Channel 340. Electrical current from Electric Eye 442 via Wiring Harness 444 connected to IGS Relief Valve 320 triggers said Valve 320 to open and vent IGS gas to the atmosphere through IGS Gas Outlet Piping 322 when the adjacent Liquid Cargo Tank 126 has been ruptured. Once IGS gas has been vented, the resulting drop in pressure draws in fluids through Aperture 335 from Channel 340 and adjoining Lower Volume 131 from Liquid Cargo Tank 126.

Figure 7:
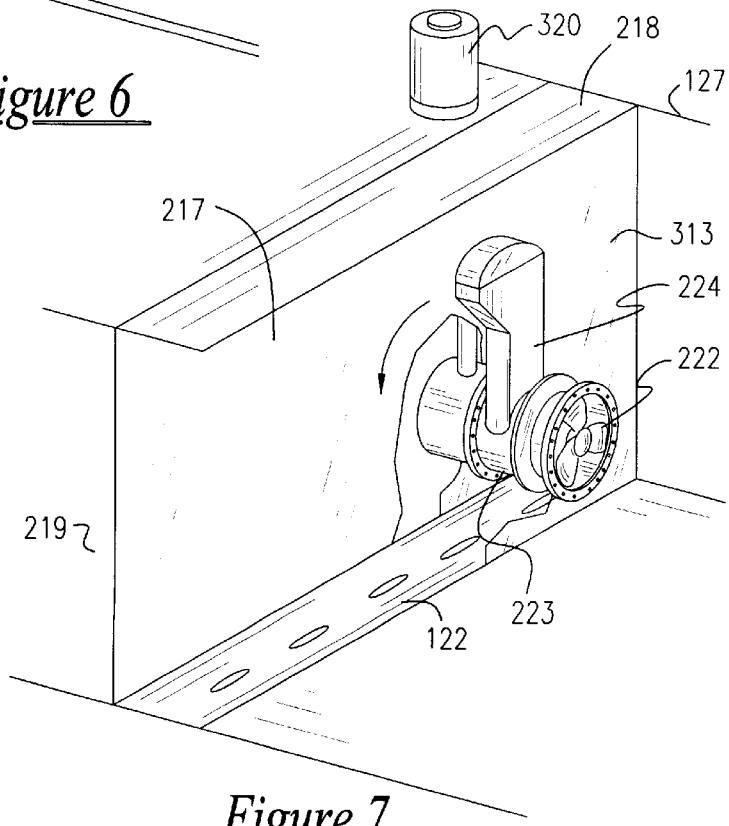
FIG. 7 shows a cutaway elevated perspective view of a hydraulic motor/impeller sump of the liquid bulk cargo tanker of FIG. 1 for use in conjunct with a liquid cargo tank.

Referring now to FIG. 7, shown is a cutaway perspective view of Sump 217 showing the placement of Hydraulic Motor 221/Impeller 222 inside Sump 217. Also shown is a plurality of Elongated Apertures 125 formed in Oil Deck Plate 122 which serves as the bottom wall of Sump 217. The Apertures 125 allow free fluid communication of liquid cargo from the Lower Volume 131 of Liquid Cargo Tank 126 into Sump 217 where Impeller Housing Inlet Piping and Float 224 connected to Hydraulic Motor 122/Impeller 222 receives liquid cargo to be pumped into Expandable Bladder 210. Impeller Housing Inlet Piping and Float 224 is made of floatable material so that the inlet end will float at the surface of the liquid cargo in Sump 117 as the liquid level rises and falls. The other end rotates about the Impeller Housing 223.

Figure 8:
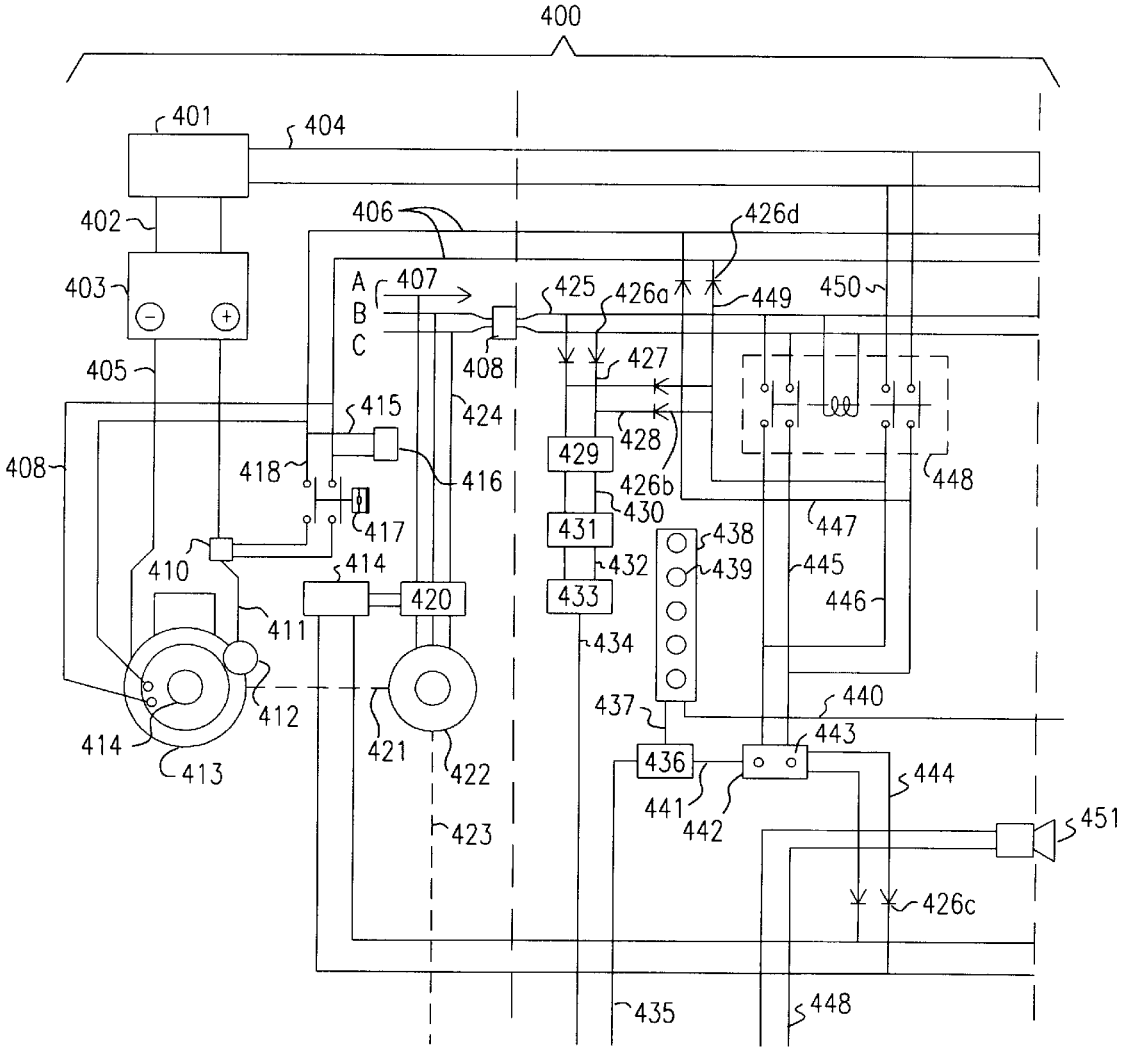
FIG. 8 shows a schematic of the electrical control and power system for the emergency expandable bladder system of the of the liquid bulk cargo tanker of FIG. 1.

Referring now to FIG. 8, shown is a schematic of the Emergency Expandable Bladder Power and Control System 400. Three-phase alternating current from Tanker 100 Ship's Service Power 407 supplies an Electric Motor 422 which provides rotary power via a Shaft 423 to Hydraulic Pump 503 used to drive Hydraulic Motor 122/Impeller 222. Electric Motor 422 is energized via an Electric Motor Contactor 422 upon signal from Electric Eye 422 via wiring harness 444. Electric Eye 442 deploys the Emergency Bulk Oil Recovery System by signaling said Electric Motor Contactor 420 when said light source has been interrupted and no longer present at Fibre Optic Cable 441. Fiber Optic Cable 441 normally receives said a light source from Beam Splitter 436. Beam splitter 436 inputs said light source from Fibre Optic Cable 435 returning from said tank rupture sensing means and breaks said light source into two separate beams for providing a first output and a second output. The first output is connected to Fibre Optic Cable 441 and the second output is connected to Annunciator Panel 438 via Fibre Optic Cable 437 for lighting Annunciator Light 439 located within said Annunciator Panel 438. Annunciator Panel 438 is located in the pilot house of Tanker 100 for alerting the crew by the extinguishment of Annunciator Light 439 (normally lighted) and the sounding of Horn 451 that the Emergency Bulk Liquid Cargo Spil Prevention System 210 is deploying. Fibre Optic Cable 435 receives light source from one end of Fibre Optic Jumper 601*c* inserted through Fibre Optic Switch 601 and ganged in series to a plurality of Fiber Optic Switches 601. Any one of the Fibre Optic Switches 601 can interrupt the light source indicating a rupture in Liquid Cargo Tank 126. The other end of the Fibre Optic Jumper Cable 601*c* normally receives light source from one end of Fibre Optic Cable 434. The other end of Fibre Optic Cable 434 is connected to Light Beam Emitter 433, which is the light beam source. Light Beam Emitter 433 is connected to Switch 431 via Wiring Harness 432. Switch 431 is connected to Step Down Transformer 429 via Wiring Harness 430. Switch 431 is normally closed but can be opened to cut power to Light Beam Emitter 433 to manually deploy Expandable Bladder 210. Step Down Transformer 429 receives higher voltage from said main power bus and supplies reduced voltage to Light Beam Emitter 433. Main Power Bus 425 distributes power to the various electrical components of said system and is configured so that a control circuit for an Emergency Bulk Liquid Cargo Spill Prevention System for each Liquid Cargo Tank 126 may be added in parallel. The Main Power Bus 425 receives single phase a/c power from a Two-Wire Step-Down Transformer 408 which has been converted from conventional ship's service three AC power 407. Power from Main Power Bus 425 is also supplied to Electric Eye 442 via Wiring Harness 445 and, when appropriate, to Relay 419 via Wiring Harness 444 to energize Electric Motor Contactor 420. Power from Main Power Bus 425 also keeps Relay 448 energized keeping a Backup Power Bus 404 electrically isolated from Light Beam Emitter 425 and Electric Eye 442.

Should Tanker 100 lose Three-phase Electrical Power 407, power in Main Power Bus 425 would also be lost and Relay 448 would no longer be energized. As a result, Main Power Bus 425 is electrically isolated from Light Beam Emitter Transformer 429 and Electric Eye 442. Power from a Backup Battery 403 is converted to ac power by Inverter 401 connected via Wiring Harness 402 to supply Backup Bus 404 with electrical power. When Relay 448 lost power from the Main Power Bus 425, the contacts then switch so that Light Beam Emitter Transformer 429 and Electric Eye 442 are no longer electrically isolated from Backup Power Bus 404 and now draw power from Backup Power Bus 404. At the same time, de-energized Relay 448 sends electrical current to Wiring Harness 406 which energizes Starter Motor Relay 410 sending current to Diesel Engine Starter Motor 412 to start Backup Diesel Engine 413. An Oil Pressure Switch 417 interrupts current to Diesel Engine Starter Motor 412 when Backup Diesel Engine 413 has started and developed sufficient oil pressure. Backup Diesel Engine 413 provides the rotary power formally supplied by the Electric Motor 422 via Shaft 421 connected to Shaft 423 via Clutch 414 activated by current from Backup Power Bus 404 delivered via Wiring Harness 409, 406, 449, Relay 448, and Wiring Harness 450 to deliver rotary power to Hydraulic Pump 503. Backup Diesel Engine 413 is provided with a Fuel Valve Switch 416 which must be supplied current from Wiring Harness 406 before Backup Diesel Engine 413 will start.

Diodes are placed in all wiring harnesses where electrical connections are required to the control circuits from both Main Power Bus 425 and Backup Power Bus 405 to prevent backflow of current from the active power source when the inactive power source is electrically isolated from the control circuit. Diodes 426 are placed in Wiring Harness 427, Diodes 426*b* in Wiring Harness 428, Diodes 426*c* in Wiring Harness 444 and Diodes 426*d* in Wiring Harness 449. Additional control units may be added to Backup Power Bus 404 according to the number of Liquid Cargo Tanks 126 Tanker 100 is configured with.

Figure 9:
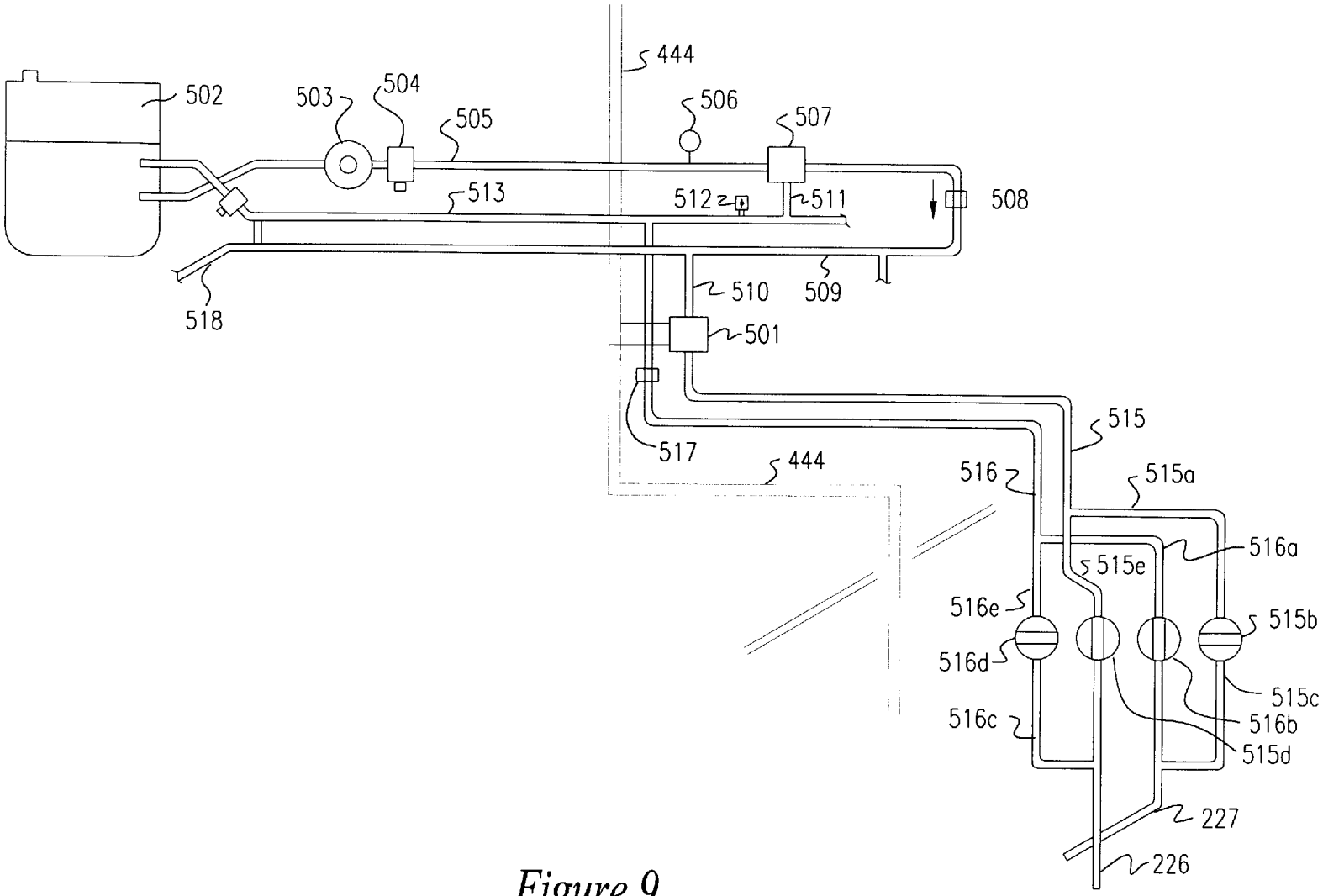
FIG. 9 shows a schematic of the hydraulic power system and piping for the emergency expandable bladder system of the of the liquid bulk cargo tanker of FIG. 1.
Figure 10A:
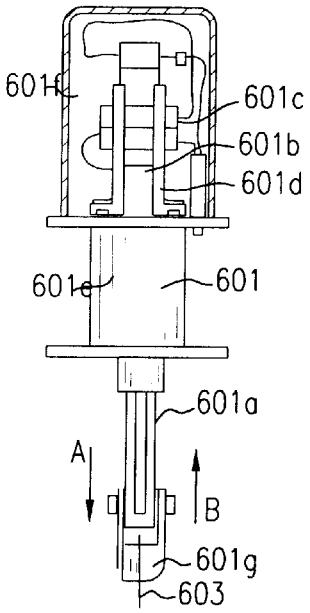
FIG. 10*a* shows a front cutaway view of one of the fibre optic switch's of the emergency expandable bladder system of the of the liquid bulk cargo tanker of FIG.
Figure 10B:
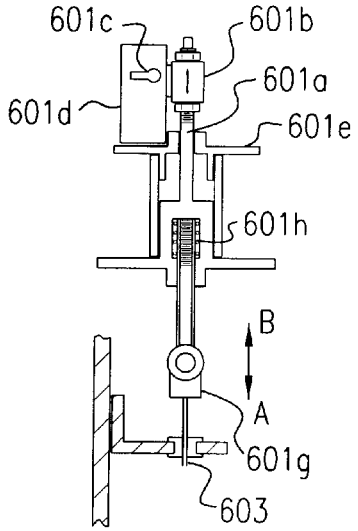
FIG. 10*b* shows a side cutaway view of one of the fibre optic switch's of the emergency expandable bladder system of the of the liquid bulk cargo tanker of FIG. 1.
Figure 10C:
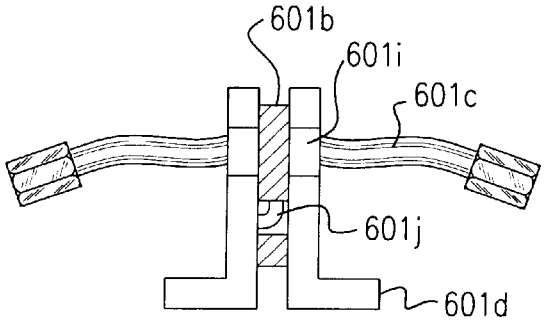
FIG. 10*c* shows a side cutaway view of the fibre optic jumper cable inserted in the cradle assembly and the cutter mechanism from the fibre optic switch of FIGS. 10*a* and 10*b;*
Figure 10D:
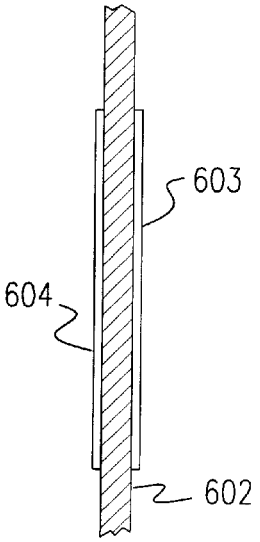
FIG. 10*d* shows a cross sectional elongated longitudinal view of a sense cable conduit showing the hollow teflon liner contained coaxially within the conduit and a sense cable located coaxially and slidably within said liner.

Referring now to FIG. 9, Hydraulic Power Subsystem 500 is shown for the Emergency Expandable Bladder Assembly 200. Rotary power from either Electric Motor 422 or Diesel Engine 413 drives Hydraulic Pump 503 via Shaft 423 creating hydraulic pressure in conventional hydraulic fluid in Hydraulic Supply Piping 505. Hydraulic fluid is filtered by a Filter 504 and regulated by a Regulator 507. Excess pressure is vented by Regulator 507 by returning fluid to a Return Manifold 513 via Piping 511. In the case of extreme excess pressure, a Safety Relief Valve 512 is provided. A supply of hydraulic fluid feeding Hydraulic Pressure Supply Piping 505 and a place for storing returning hydraulic fluid from Return Manifold 517 is found at Reservoir 502. Controlling when pressurized hydraulic fluid is to be supplied to Hydraulic Supply Piping 515 is electrically operated Valve 501 which opens upon a signal from the Electric Eye 442 via Wiring Harness 444. Similarly, such a valve could be added to Manifold 509 for each Liquid Cargo Tank 126 installed in Tanker 100. Hydraulic fluid pressure is now being supplied to a Hydraulic Motor 221 to drive an Impeller 222 to pump liquid cargo from the Liquid Cargo Tank 126 into the Expandable Bladder 210. A plurality of Valves 515*b*, 515*d*, 516*b*, 516*e*, shown in FIG. 9 in their normal positions, is used in conjunction with a plurality of interconnecting crossflow Piping Sections 515*a*, 515*c*, 515*e*, 516*a*, 516*c*, 516*e* to reverse the flow of hydraulic fluid being supplied to Hydraulic Motor 422. In the reverse flow configuration, said Valves 515*b*, 515*d*, 516*b*, and 516*e* are manually placed in their opposite to normal positions and Piping Sections 515*a*, 515*c*, 515*e*, 516*a*, 516*c*, and 516*e* connect Supply Piping 515 to Hydraulic Motor Discharge Piping 227 and conversely, connect Hydraulic Return Piping 516 to Hydraulic Motor Supply Piping 226. This is desirable when the when the rupture in Hull 110 is repaired and it is desired to pump the liquid cargo from the Expandable Bladder 210 back into Liquid Cargo Tank 126. The reversed flow of hydraulic fluid reverses the rotary action of Impeller 222 drawing liquid cargo fluids from within Expandable Bladder 210 and pumping it back into Sump 217 through Impeller Housing Inlet Piping and Float 224. Of course Valve 330 must be put back into the closed position before this is accomplished. A limit switch can be installed to sense when the Expandable Bladder 210 is fully deployed to stop Hydraulic Motor 122. Conversely, another limit switch can be installed to sense when Expandable Bladder 210 has been completely emptied to stop Hydraulic Motor 122.

Referring now to FIG. 10, a front view of a Fiber Optic Switch 601 is shown comprising a Fiber Optic Jumper 601*c*, a Switch Body 601*e* forming the structure for said Fiber Optic Switch 601, a Cradle 601*d* having a pair of dual arms with a cavity therebetween and permanently affixed to said Switch Body 601*e*, a Plunger 601*a*, a Spring 601*h*, a Cutter 601*b*, and a Switch Cover 601*f*. The Fiber Optic Jumper 601*c* is made from a piece of fiber optic cable and is designed to traverse through Apertures 601*i* specially formed through both Cutter 601*b* and said dual arms of Cradle 601*d*. Cutter 601*b* is slidably sandwiched between the dual arms of Cradle 601*d* with Fiber Optic Jumper 601*c* passing through Aperture 601*i* of Cradle 601*d* and an Aperture 601*j* formed in Cutter 601*b*. The lower end of Cutter 601*b* is connected to one end of a Plunger 601*a* having an Eyelet 601*k* at one end for connection to a Sense Cable 602. Said Plunger 601*a* is designed to traverse vertically within an interior cavity of said Switch Body 601*e* specially formed to receive said Plunger 601*a* and connected to a Cutter 601*b* at one end and an eyelet 601*k* at the other end. Upon assembly, Sense Cable 602 is tensioned in its operating position and attached to Eyelet 601*k*. A Hull 110 distortion will cause either a breakage of said Sense Cable 602 causing said Plunger 601 biased by said Spring 601*h* to force Cutter 601*b* in an upward fashion and cutting the Fiber Optic Jumper 601*c* or causing a tensioning of said Sense Cable 602 and pulling said Plunger 601 in a downward direction again causing said Cutter 601*b* to cut said Fiber Optic Jumper 601*c* and in either case cause an interruption of a light source propagating through said Jumper 601*c*. Now Cutter 601*b* blocks the light source normally propagating through said Jumper 601*c* sending a signal to the Electric Eye 442 to start the Emergency Expandable Bladder System 200 operating.

Referring now to FIG. 11, a side view of Cradle 601*d* is shown showing the installation of Fiber Optic Jumper 601*c* through the dual arms of Cradle 601*d* and Cutter 601*b* slidably sandwiched therebetween.

The foregoing description is included to illustrate the operation of the preferred embodiment and is not meant to limit the scope of the invention. The scope of the invention is to be limited only by the following claims.

What is claimed is:

1. An Emergency Bulk Liquid Cargo Spill Prevention System for a bulk liquid cargo tank for use with a bulk liquid cargo tankers having hull sidewalls and a bottom hull, said system comprised of:

a bulk liquid cargo tank, said bulk liquid cargo tank positioned on said tanker in such a manner that bulk liquid in said tank is in hydrostatic lock should a rupture in said tank occur along with buoyancy and stability considerations;

an expandable bladder assembly, said expandable bladder assembly consisting of an expandable, liquid tight bladder having an interior volume for receiving liquid cargo from a ruptured bulk liquid cargo tank;

a bulk liquid cargo tank rupture sensing means, said tank rupture sensing means adapted to line lining an outboard sidewall of said tank also serving as said tanker's hull sidewalls, and a bottom wall of said tank also serving as said tanker's bottom hull and designed to sense a distortion in said walls of said tank indicating a rupture of said tank;

an emergency expandable bladder power and control system, said power and control system designed to receive indicia of a tank rupture from said tank rupture sensing means and automatically deploy said emergency expandable bladder assembly;

means to rapidly move liquid cargo from a ruptured bulk liquid cargo tank into the interior volume of said expandable bladder, said means designed to receive indicia of a tank rupture from said emergency bladder control system and automatically and rapidly move bulk liquid from a ruptured bulk liquid cargo tank into the interior volume of said expandable bladder; and means to remove said liquid cargo from said emergency expandable bladder and put it back into said liquid cargo tank and retract said bladder back into a stowed configuration after a rupture in said tank has been repaired.

2. The Emergency Bulk Liquid Cargo Spill Prevention System of claim 1, wherein:

said bulk liquid cargo tank sidewalls are further defined by a portion of said tanker's main deck plate, said hull bottom, said hull sidewall, a forward sidewall, an aft sidewall, and is separated into an upper volume and a lower volume by an oil deck plate; and wherein said expandable bladder is manufactured to conform exactly to the inner contour of said upper volume of said bulk liquid cargo tank when fully expanded, is adapted to be stowed folded in a pleated manner against said inboard sidewall of said liquid cargo tank for rapid deployment, and designed to be deployed rapidly in a sidewise fashion from said inboard sidewall of said tank to said hull sidewall.

3. The Emergency Bulk Liquid Cargo Spill Prevention System of claim 2, wherein said emergency expandable bladder is adapted to be slidably suspended overhead by a plurality of tracks traversing the top of said tank for receiving a plurality of rollers slidably inserted in a slot specially formed therein and connected to the top of said bladder via a hangar connected to each of said rollers.

4. The Emergency Bulk Liquid Cargo Spill Prevention System of claim 1, wherein said tank rupture sensing means is comprised of:

a plurality of fiber optic switches, said plurality of fiber optic switches ganged in series through fiber optic cabling and designed to interrupt a beam of light flowing through said switches upon indicia to any one of said switches that a bulk liquid cargo tank has been ruptured;

a plurality of sense cables, said plurality of sense cables lining the inner surfaces of said tank walls that also serve as a portion of the ship's hull at evenly spaced intervals and designed to transmit an indicia of a distortion in said tank walls to said fiber optic switches;

a plurality of conduits, each of said cable conduits containing coaxially therein a hollow Teflon sleeve which has located coaxially and slidably therein one of said sense cables and connected to one of said fiber optic switches.

5. The Emergency Bulk Liquid Cargo Spill Prevention System of claim 4, wherein each of said plurality of fiber optic switches further comprises:

a switch body, said switch body providing the structure for said fiber optic switch;

a plunger, said plunger designed to traverse vertically within an interior cavity of said switch body specially formed to receive said plunger and connected to a cutter at one end and to an eyelet at the other end;

a cradle, said cradle having a pair of dual arms forming a cavity therebetween and permanently affixed to said switch body;

a cutter, said cutter connected at one end of said plunger and slidably sandwiched in said cavity between said dual arms of said cradle;

a jumper, said jumper made from a piece of fiber optic cable and designed to traverse through apertures specially formed through both the cutter and said dual arms of said cradle;

a spring, said spring used to bias the plunger in an upward direction;

a switch cover, said switch cover designed to encase the switch body, said cradle, said plunger, said spring, and said jumper; and whereas a distortion in said tank walls will cause either a breakage of said sense cables causing the plunger biased by said spring to force the cutter in an upward fashion and cutting the fiber optic jumper or causing a tensioning of said sense cable and pulling said plunger in a downward direction again causing said cutter to cut said fiber optic jumper and in either case cause an interruption of a light source propagating through said jumper.

6. The Emergency Bulk Liquid Cargo Spill Prevention System of claim 1, wherein said emergency expandable bladder power and control system further comprises:

a main power bus, said main power bus distributing power to the various electrical components of said emergency expandable bladder control system;

a two wire step down transformer, said two wire step down transformer receiving conventional ship's service three phase AC power and converting it to single phase AC power at a lower voltage for supplying power to said main power bus;

a light beam emitter, said light beam emitter providing a light beam source connected to one end of fiber optic cabling that is used to transmit said light source to said tank rupture sensing means. a step down transformer, said step down transformer receiving higher voltage from said main power bus and supplies power at a reduced voltage to said light beam emitter;

a beam splitter, said beam splitter inputting a light source from fiber optic cabling returning from said tank rupture sense means and breaking up said light source into two separate beams and providing it to a first output and a second output;

an electric eye, said electric eye receiving said light source from said first output of said beam splitter for detecting when said light source has been interrupted by said fiber optic switch plunger cutting said fiber optic jumper;

an annunciator panel, said annunciator panel connected via fiber optic cabling to said second output of said beam splitter and being located in the pilot house of said tanker;

an annunciator light, said annunciator light located within said annunciator panel and normally lit but extinguished when said Emergency Bulk Liquid Cargo Spill Prevention System is deploying;

a horn, said horn sounding when said Emergency Bulk Liquid Cargo Spill Prevention System is deploying.

7. The Emergency Bulk Liquid Cargo Spill Prevention System of claim 6, wherein said emergency expandable bladder control system further comprises:

a battery, said battery for providing electrical power in the event conventional shipboard three-phase alternating current is unavailable;

an inverter, said inverter for converting DC current from said battery to alternating current;

a backup power bus, said backup power bus for receiving said alternating current from said inverter for distributing power to said emergency bladder control system in the event conventional shipboard three-phase alternating current is unavailable;

a relay, said relay for normally placing said main power bus in electrical communication with said emergency bladder control system and alternately, for isolating said main power bus from said emergency bladder control system in the event conventional shipboard three-phase alternating current is unavailable and placing said backup power bus in electrical communication with said emergency bladder control system;

a plurality of diodes, said diodes for preventing backflow of current between said main power bus and said backup power bus.

8. The Emergency Bulk Liquid Cargo Spill Prevention System of claim 7, wherein said means to rapidly move the contents of a ruptured bulk liquid cargo tank into the interior volume of said expandable bladder is comprised of:

an electric motor, said electric motor for supplying rotary power and energized via power from said main power bus in the event of a rupture in said tank;

a hydraulic pump, said hydraulic pump receiving said rotary power from said electric motor via a shaft for generating hydraulic pressure;

a hydraulic manifold, said manifold for distributing and collecting said pressurized hydraulic fluid;

a hydraulic reservoir, said reservoir for maintaining a supply of conventional hydraulic fluid for supplying said manifold;

hydraulic piping, said hydraulic piping for transmitting and receiving hydraulic fluid from said hydraulic manifold;

a hydraulic motor, said hydraulic motor receiving said pressurized hydraulic fluid from said hydraulic piping for generating rotary power;

an impeller, said impeller driven by said hydraulic motor and encased together in a housing located in an enclosure adjacent to said tank and in fluid communication with the interior volume of said bladder;

an impeller housing inlet piping and float, said impeller housing inlet piping and float having one end in fluid communication with said impeller and designed to rotate about said housing so the other end stays in constant fluid communication with liquid cargo in said enclosure;

whereas in the event of a tank rupture, said electric motor is energized and pressurized hydraulic fluid from said manifold drives said impeller which draws fluid from said enclosure and pumps it into said interior volume of said bladder.

9. The Emergency Bulk Liquid Cargo Spill Prevention System of claim 7, wherein said means to rapidly move the contents of a ruptured bulk liquid cargo tank into the interior volume of said expandable bladder is further comprised of:

an oil deck, said oil deck segregating said tank into an upper volume and a lower volume with a plurality of elongated holes formed therethrough allowing fluid communication between said upper and lower volume;

a segregated ballast tank, said segregated ballast tank located inboard of said liquid cargo tank and adjacent to said sump and normally pressurized with an inert gas;

a channel, said channel for interconnecting said lower volume, said sump, and said segregated ballast tank and formed by a plurality of apertures formed through a plurality of longitudinal structural members of said tanker and fitted with a plurality of one way flapper valves to prevent backflow of liquid cargo into a ruptured liquid cargo tank;

an orifice, said orifice formed in the bottom of said segregated ballast tank and fitted with a valve assembly normally shut but automatically opened when signaled by said emergency expandable bladder control system for allowing fluid communication between said channel and said segregated ballast tank;

a plurality of orifices, said plurality of orifices formed in the bottom of said sump for allowing fluid communication between said sump and said channel;

a relief valve, said relief valve affixed to said segregated ballast tank normally preventing the escape of said inert gas to the atmosphere and otherwise releasing said inert gas to the atmosphere when signaled by said emergency expandable bladder control system;

whereas in the event of a rupture in said liquid cargo tank, liquid cargo is drawn into said segregated ballast tank by a drop in pressure in said tank caused by said inert gas being vented to the atmosphere and further drawn by gravity into said channel past said flapper valves into said sump for pumping into said expandable bladder.

10. The Emergency Bulk Liquid Cargo Spill Prevention System of claim 9, wherein a diesel engine is used to deliver rotary power to said hydraulic pump via said shaft instead of said electric motor in the event conventional shipboard three phase electrical power is unavailable.

11. The Emergency Bulk Liquid Cargo Spill Prevention System of claim 8, wherein said means to remove said liquid cargo from said emergency expandable bladder and put it back into said liquid cargo tank and retract said bladder back into a stowed configuration after a rupture in said tank has been repaired consists of a plurality of hand operated cross-mixing valves in said hydraulic piping to reverse the direction of said hydraulic motor.

12. The Emergency Bulk Liquid Cargo Spill Prevention System of claim 11, wherein a limiting switch is used to sense when said expandable bladder is full or empty to send indicia to said emergency expandable bladder control system to shut off said hydraulic motor.

13. The Emergency Bulk Liquid Cargo Spill Prevention System of claim 10, wherein said valve assembly is closed after said segregated ballast tank is full of liquid cargo and a means consisting of piping and an oil/water separator is used to pump liquid cargo from within said segregated ballast tank to said emergency expandable bladder to restore stability and buoyancy and to pump separated seawater overboard.

* * * * *